US011447288B2

(12) United States Patent
Wallner

(10) Patent No.: US 11,447,288 B2
(45) Date of Patent: Sep. 20, 2022

(54) EXPANDABLE MESH FOOD SUPPORT

(71) Applicant: Ralf Wallner, Alpharetta, GA (US)

(72) Inventor: Ralf Wallner, Alpharetta, GA (US)

(73) Assignee: WALLNER EXPAC, INC., Ontario, CA (US)

( * ) Notice: Subject to any disclaimer, the term of this patent is extended or adjusted under 35 U.S.C. 154(b) by 0 days.

(21) Appl. No.: 17/173,163

(22) Filed: Feb. 10, 2021

(65) Prior Publication Data

US 2021/0163173 A1 Jun. 3, 2021

Related U.S. Application Data

(62) Division of application No. 15/911,652, filed on Mar. 5, 2018, now abandoned.

(60) Provisional application No. 62/507,701, filed on May 17, 2017.

(51) Int. Cl.

| | |
|---|---|
| ***B65D 5/50*** | (2006.01) |
| ***B65D 85/36*** | (2006.01) |
| ***B65D 85/34*** | (2006.01) |
| ***B65D 65/42*** | (2006.01) |
| ***B65D 5/42*** | (2006.01) |
| ***B65D 65/46*** | (2006.01) |
| ***B31F 1/08*** | (2006.01) |
| ***B31D 5/00*** | (2017.01) |
| ***B65D 81/26*** | (2006.01) |
| ***B31D 3/02*** | (2006.01) |

(52) U.S. Cl.

CPC ..... *B65D 5/5035* (2013.01); *B31D 3/0292* (2013.01); *B31D 5/0004* (2013.01); *B31F 1/08* (2013.01); *B65D 5/4212* (2013.01); *B65D 5/503* (2013.01); *B65D 65/42* (2013.01); *B65D 65/466* (2013.01); *B65D 81/261* (2013.01); *B65D 85/34* (2013.01); *B65D 85/36* (2013.01); *B31D 2205/0005* (2013.01); *B65D 2585/366* (2013.01)

(58) Field of Classification Search

CPC .... B65D 5/5035; B65D 5/4212; B65D 5/503; B65D 65/42; B65D 65/466; B65D 81/261; B65D 85/34; B65D 85/36; B65D 2585/366; B31D 3/0292; B31D 2205/0005

USPC ..... 229/120.32; 206/551

See application file for complete search history.

(56) References Cited

U.S. PATENT DOCUMENTS

| | | | |
|---|---|---|---|
| 2,656,291 | A | 10/1953 | Doll |
| 3,642,550 | A | 2/1972 | Doll |
| 3,655,501 | A | 4/1972 | Tesch |
| 3,781,183 | A | 12/1973 | Doll |
| 3,958,751 | A | 5/1976 | Bruno |
| 4,105,724 | A | 8/1978 | Talbot |
| 4,195,746 | A | 4/1980 | Cottrell |
| 4,373,636 | A | 2/1983 | Hoffman |
| 4,533,585 | A | 8/1985 | Holden |
| 4,832,228 | A | 5/1989 | Hickey |
| 5,207,020 | A | 5/1993 | Aslam |
| 5,423,477 | A | 6/1995 | Valdman |

(Continued)

*Primary Examiner* — Jacob K Ackun

(74) *Attorney, Agent, or Firm* — Lewis Roca Rothgerber Christie LLP

(57) ABSTRACT

A food support tray comprised of an expanded paperboard mesh tray insert for a delivery carton such as a pizza carton or a fresh produce clamshell. The expanded paperboard mesh is adapted for supporting pizza or other food items on the bond peaks of the expanded mesh, thus isolating the food item from oil and juices that could make the fresh food item turn soggy.

20 Claims, 9 Drawing Sheets

(56) References Cited

U.S. PATENT DOCUMENTS

| | | | | | |
|---|---|---|---|---|---|
| 5,482,724 | A * | 1/1996 | Morici | B65D 65/42 | 229/119 |
| 5,500,271 | A | 3/1996 | Pasch et al. | | |
| 5,667,135 | A | 9/1997 | Schaefer | | |
| 5,667,871 | A | 9/1997 | Goodrich et al. | | |
| 5,688,578 | A | 11/1997 | Goodrich | | |
| 5,895,698 | A * | 4/1999 | Cacciatore | B65D 81/261 | 206/525 |
| D463,745 | S * | 10/2002 | Hausen | D9/456 | |
| 7,210,613 | B2 * | 5/2007 | Lehrer | B65D 5/5021 | 229/104 |
| 7,380,702 | B2 * | 6/2008 | Oddo | B65D 5/42 | 229/104 |
| 8,613,993 | B2 | 12/2013 | Kuchar | | |
| 9,452,860 | B2 | 9/2016 | Mehta | | |
| 2011/0192890 | A1 * | 8/2011 | Chebli | B65D 81/3823 | 229/103.11 |
| 2014/0299657 | A1 * | 10/2014 | Giudilli | B65D 5/603 | 229/164.2 |
| 2016/0039561 | A1 * | 2/2016 | Stonehouse | B65D 5/4295 | 229/120 |
| 2017/0233129 | A1 * | 8/2017 | Volpis | B65D 5/4295 | 229/120 |

* cited by examiner

EXPANDABLE MESH FOOD SUPPORT

CROSS-REFERENCE TO RELATED APPLICATION(S)

This application is a divisional of U.S. patent application Ser. No. 15/911,652, filed Mar. 5, 2018, which claims the benefit of and priority to U.S. Provisional Application No. 62/507,701, filed on May 17, 2017, the entire contents of all of which are incorporated herein by reference.

FIELD OF INVENTION

This invention relates generally to a food support tray within cartons for delivering and serving pizza and other food items such as fresh fruit berries and delicate vegetables like lettuce that exude liquids and juices. In particular it is directed to an improved delivery tray insert to keep the pizza crust dry and crisp and the fruit and vegetable produce dry and airy during the delivery process.

BACKGROUND

A dosed carton is typically used to transport pizza from the vendor to the eventual customer, either by a customer pick up or a delivery service. The carton is generally made of paperboard and comprises of a base, elevated sides and a hinged lid. This carton offers a stable container for transportation and keeps the pie isolated from the environment and possible contamination and is intended to keep the pizza as warm as possible before eventual consumption.

The problem of this bask carton is that during the process of delivery, which can take thirty to forty minutes from the pizza oven to consumer consumption, the pizza can become soggy as it rests in its own juices and also lose much of its heat.

The prior art discloses various inventions to address these very problems. One such approach is disclosed in U.S. Pat. No. 4,373,636 which employs an additional plastic tray within the carton with spaced upward protruding ribs. Yet another, U.S. Pat. No. 5,885,698 employs an additional aluminum tray with a plurality of small raised cones with pin hole air vents. U.S. Pat. No. 4,321,997 discloses a pizza container having pads with upper and lower plastic sheets and an inner absorbent matt. The aforementioned prior art products would not be economical to manufacture and are not biodegradable.

The present invention addresses the aforementioned limitations of the prior art by providing an extremely cost effective and commercially affordable solution with the added benefit of being biodegradable. It has an additional benefit it can be printed, with food grade inks, with the logo of the pizza vendor or related commercial advertising. As this tray is made of paperboard it can very cost effective and gain much wider distribution than any products made of metal or plastic.

In yet another preferred embodiment the tray can be used as a support tray inside a plastic clamshell for fresh produce, vegetable or herbs. The mesh provides for increased air flow which just the clamshell base or paper diaper inserts do not.

Another feature of the pizza usage is that the slight elevation of the mesh also isolates the pizza from transferring heat to the pizza box base and the mesh traps the warm air to maintain temperature.

A feature of the produce usage is that the elevation of the mesh off the clamshell floor allow free circulation of air, assisting in the dissipation of ethylene gases, the presence of which shortens shelf life.

Another feature of the tray is that it is cellulose based and is therefore commercially desirable biodegradable. As this tray is made of paperboard as opposed to metal or plastics, it is extremely cost effective and can be broadly distributed throughout the marketplace.

BRIEF DESCRIPTION OF THE DRAWINGS

Referring to the drawings which are appended hereto and which form a portion of this disclosure, it may be seen that:

FIGS. 11 to 14 shows some of the wide range of shapes this product can be produced in.

FIGS. 16 and 17 illustrate the difference between the stock roll and the knife cut paperboard;

DETAILED DESCRIPTION

With reference now to the drawings, a new and improved food support tray or insert embodying the principles and concepts of the present invention will be described. The present invention, a new food support tray, is made of one component, paperboard. Examples of suitable paperboard include are coated SBS in the range of 14-20 pound weight, which is commercially available from Georgia-Pacific Bleached Board as Masterserve™ Clay Coated Cupstock and. Cupstock Low Moor converting paperboard such as can be purchased by large paper mills like Westrock Paper. The paperboard or cupstock should be food grade and the formed of multiple layers of chemically bleached pulp & then surface sized on the outside using starch. Usually the range of cupstock paper without a coating starts from 155 GSM (grams per square meter) to 400 GSM. In the preferred embodiment a weight of between about 250 GSM to about 350 GSM is preferred, Referring to FIGS. 1 to 5, a the new paperboard mesh insert 10 is to be placed inside the standard carton C to support a pizza P sitting on top of the support mesh insert 10 inside the pizza carton C.

Figure 1:
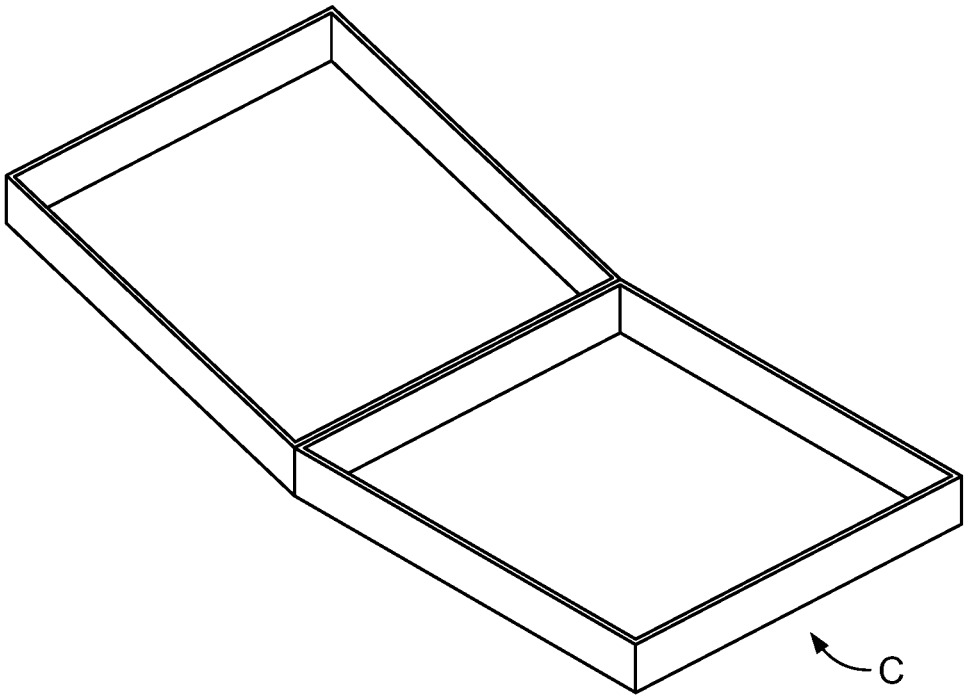
FIG. 1 shows an empty pizza carton.
Figure 2:
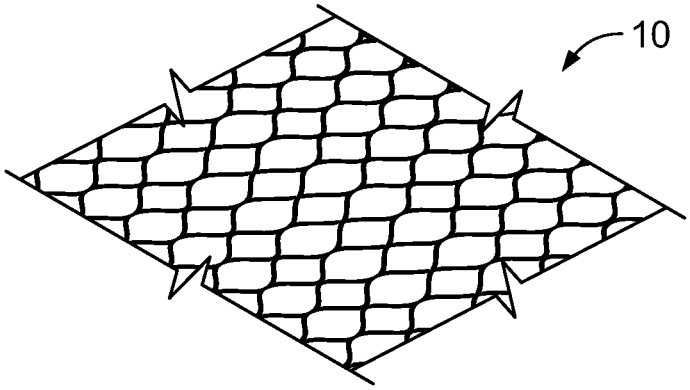
FIG. 2 shows the new paperboard mesh food insert.
Figure 3:
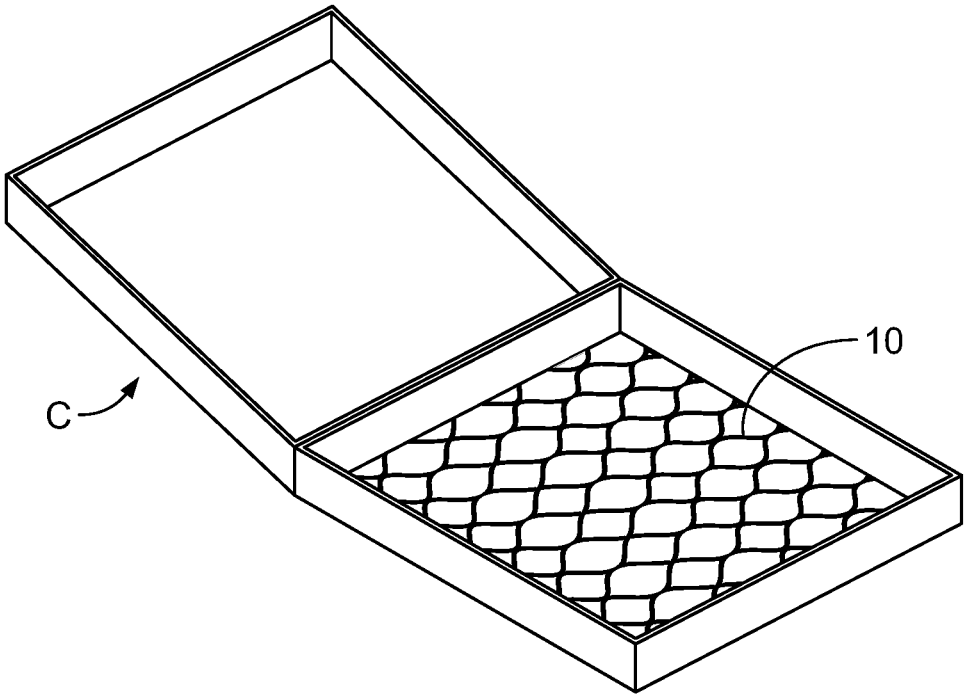
FIG. 3 shows the support tray inside the carton.
Figure 4:
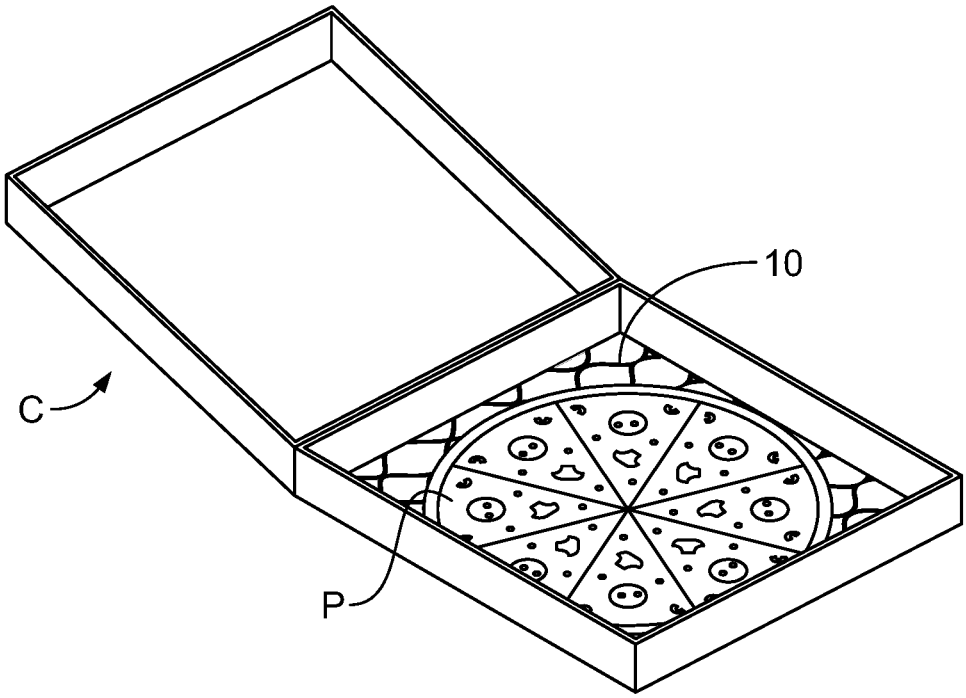
FIG. 4 shows a pizza sitting on top of the support tray inside the pizza carton.
Figure 5:
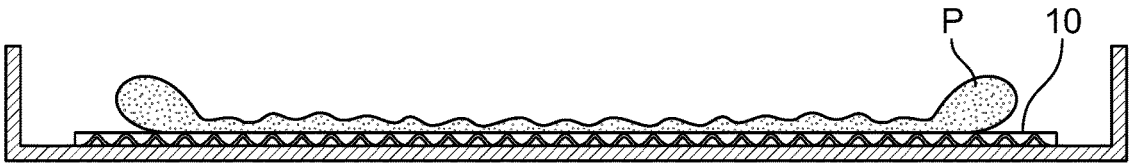
FIG. 5 shows a cross sectional view of FIG. 4.
Figure 6:
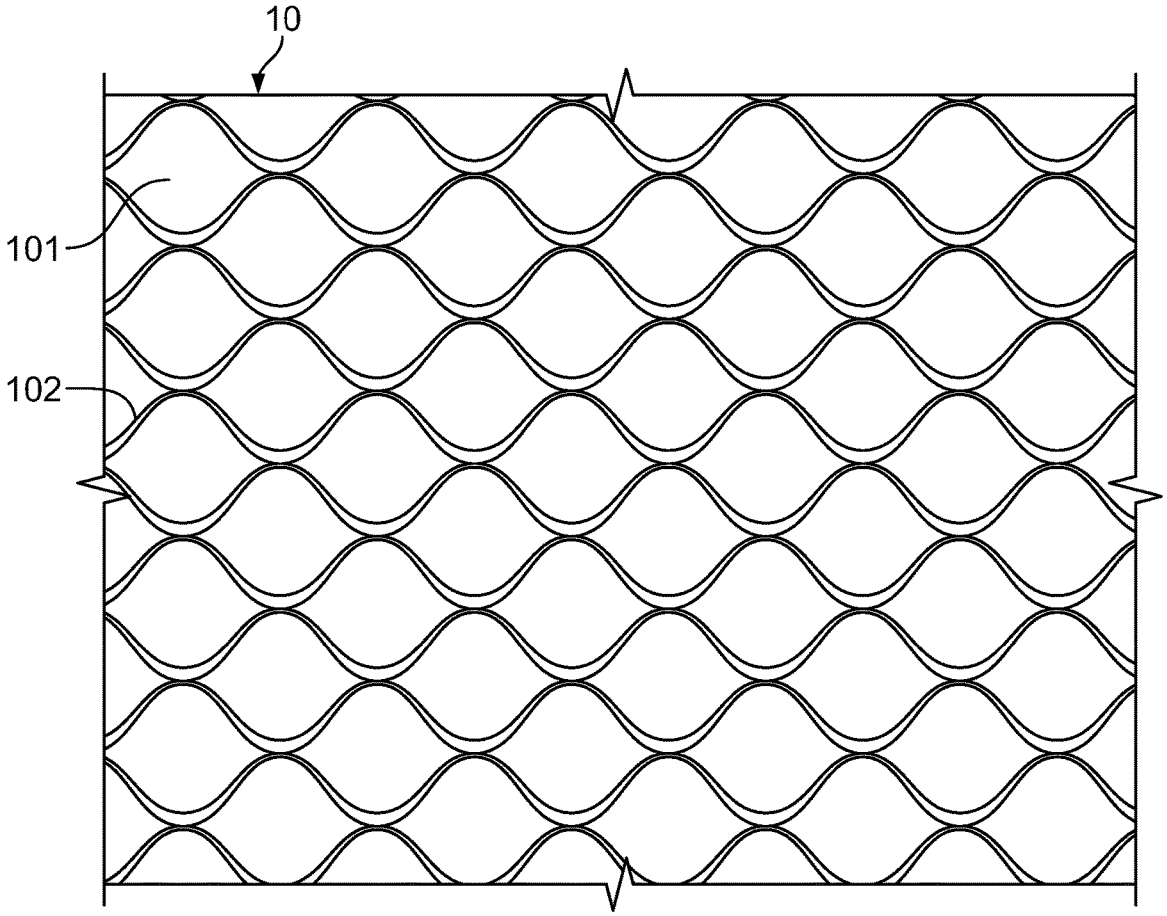
FIGS. 6, 7 and 8 show three potential mesh patterns.
Figure 7:
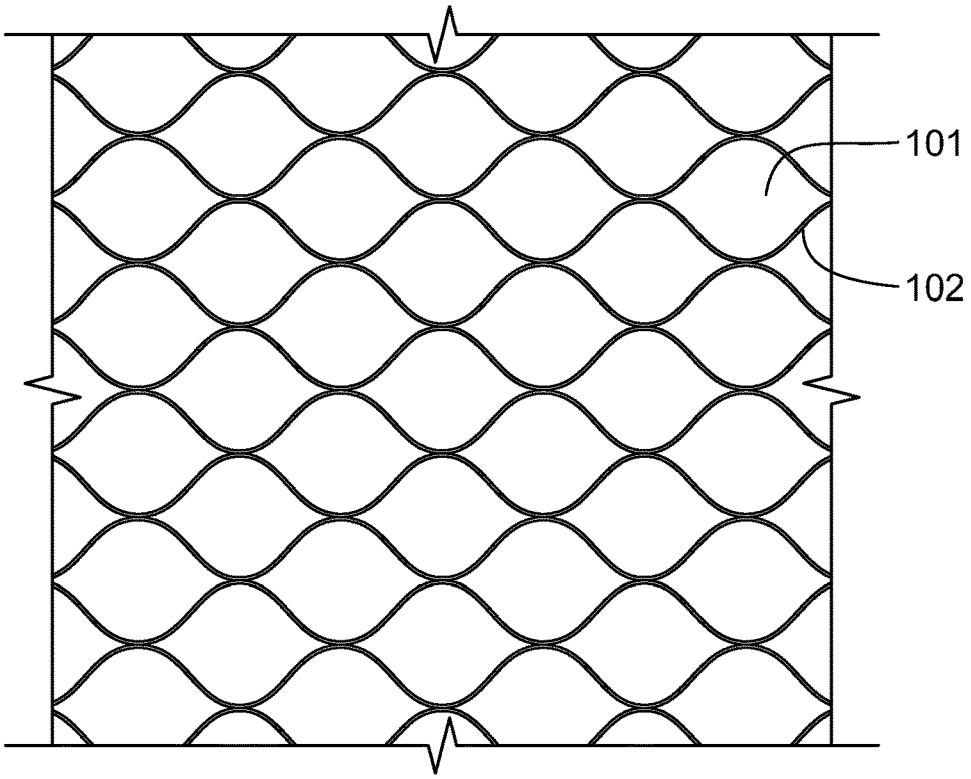
Figure 8:
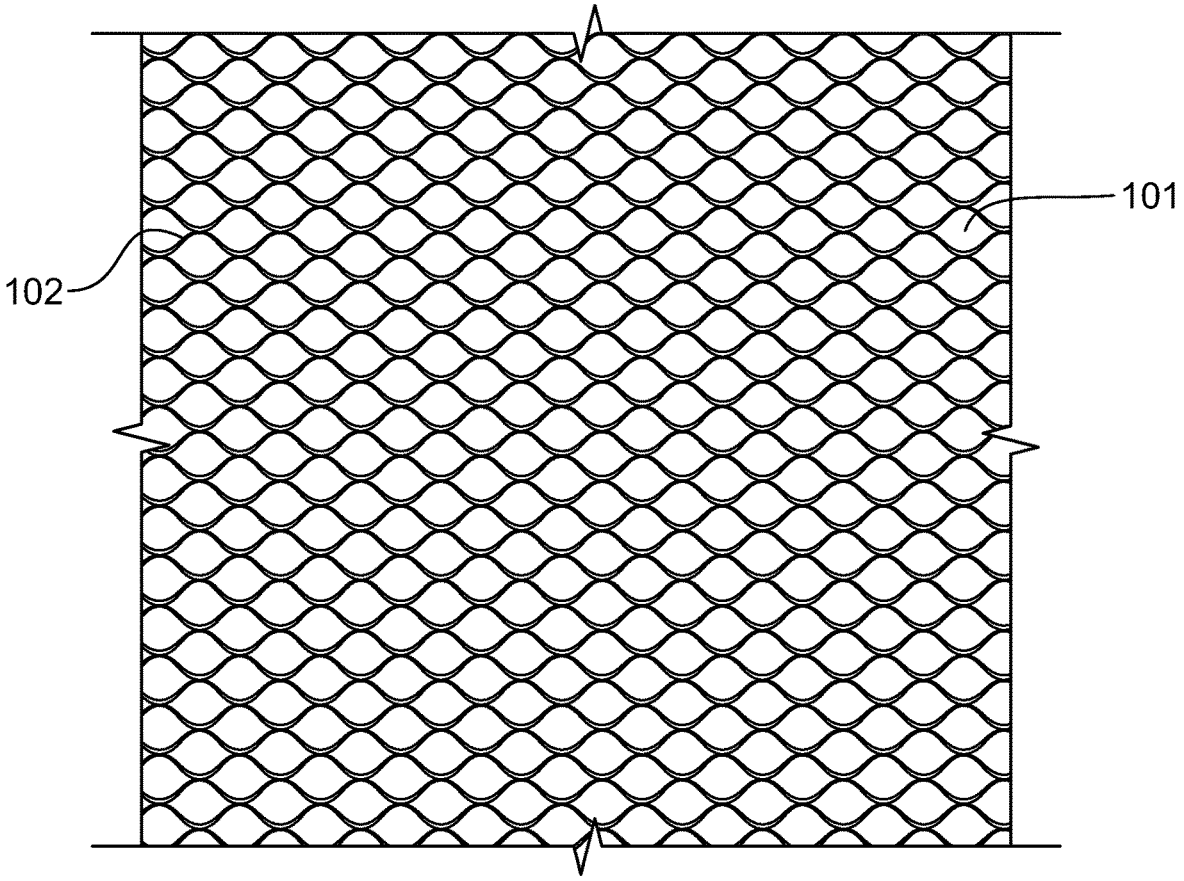

Referring to FIGS. 6 to 8, note that three of the many mesh patterns which can be provided using the instant technology and process. FIG. 6 illustrates the cell size of the preferred embodiment with each aperture having a short dimension of about 5/16" and a long dimension of about ½" however, the invention is not limited to these exact dimensions.

Figure 9:
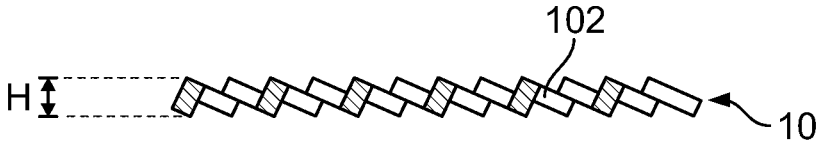
FIG. 9 shows a cross sectional view of the tray.
Figure 10:
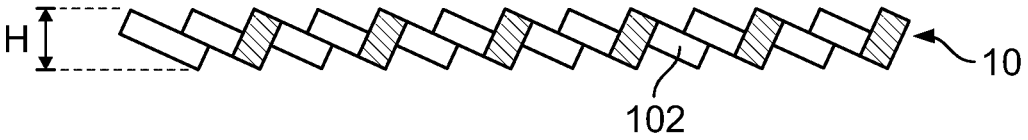
FIG. 10 shows a cross sectional view of a thicker tray.
Figure 11:
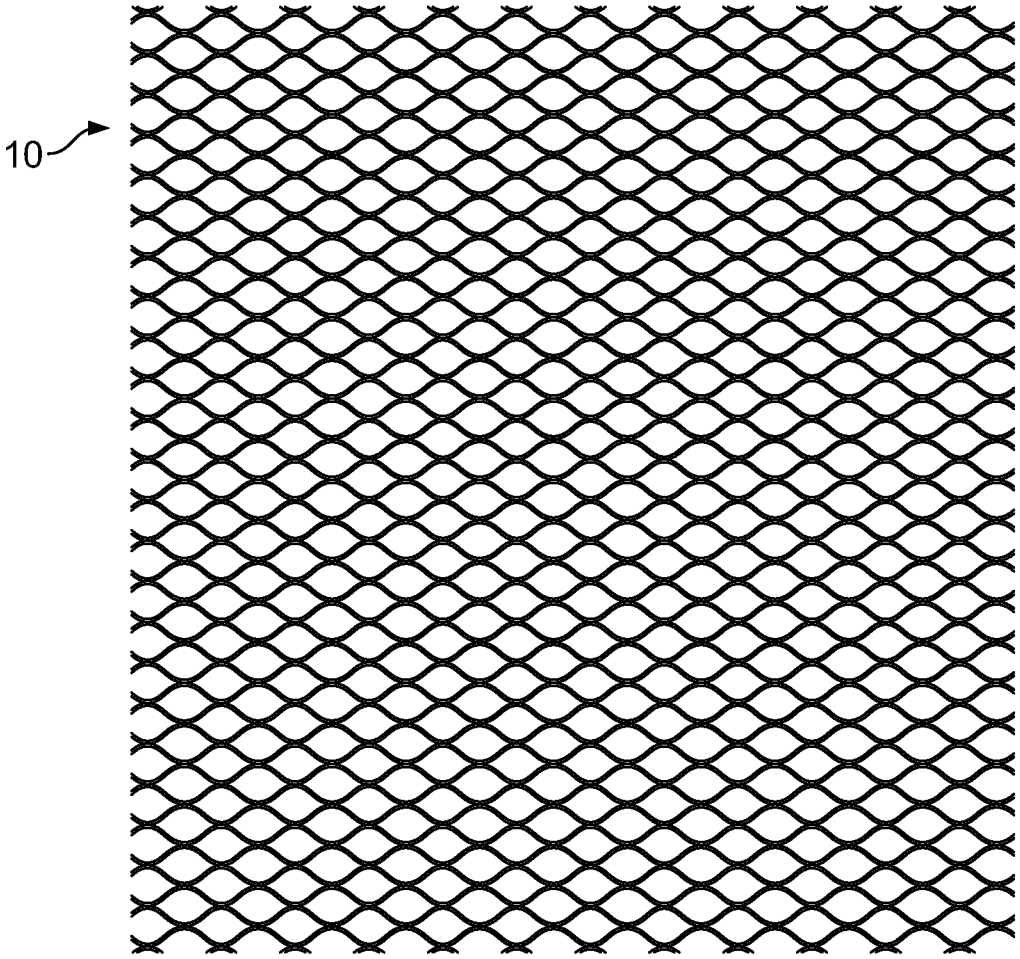
Figure 12:
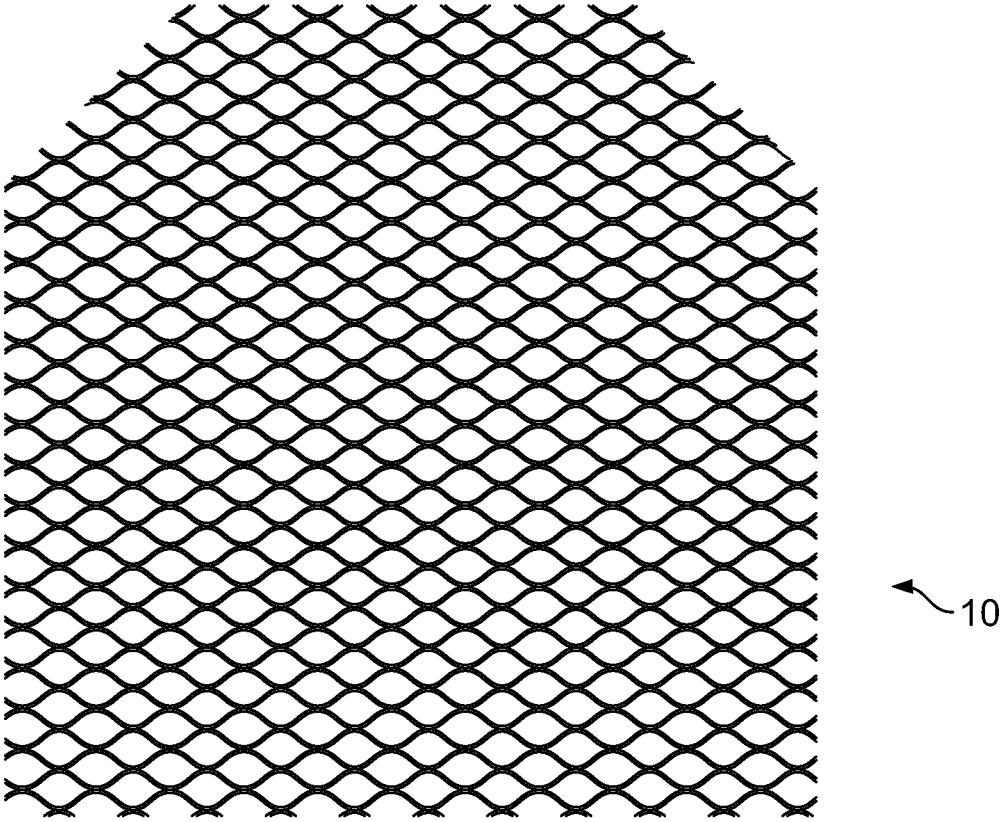
Figure 13:
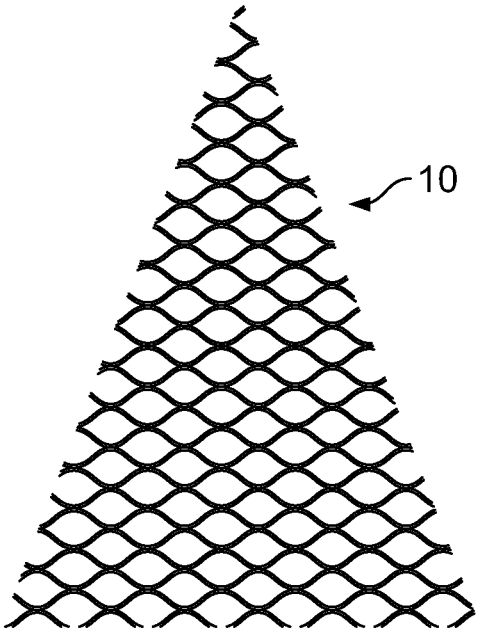
Figure 14:
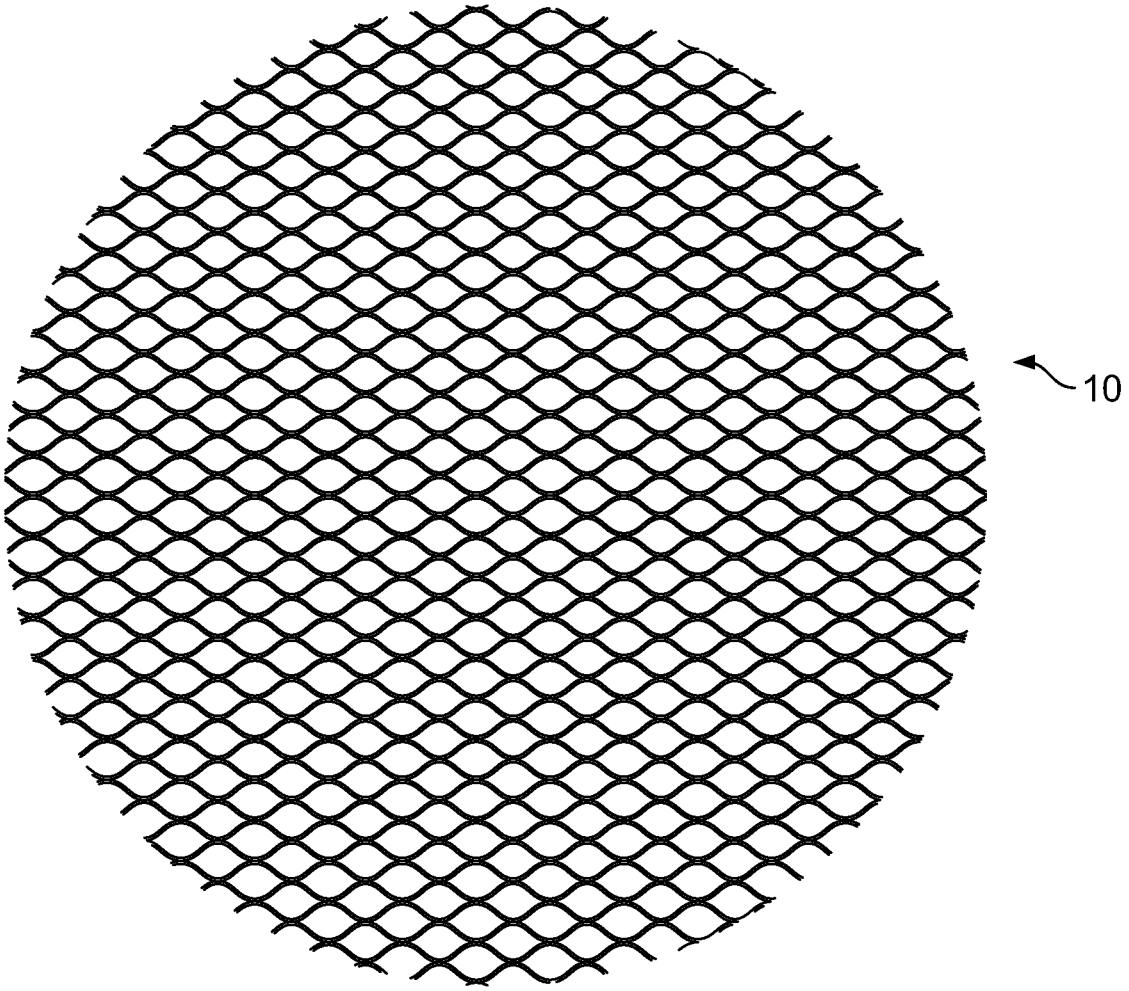

FIGS. 9& 10 shows a cross sectional view of the mesh insert 10 and illustrates how the mesh strand height H can be varied. In the preferred embodiment the strand height is ⅛". The possible range can be about 1/16" to about ¼".

FIGS. 11 to 14 show some of the wide range of shapes in which this product can be produced. The most popular would be square such as 12"×12", 14"×14", 16"×16" and 18"×18" for pizza or 3½"×3½" for fruit berries.

Figures 15, 21:
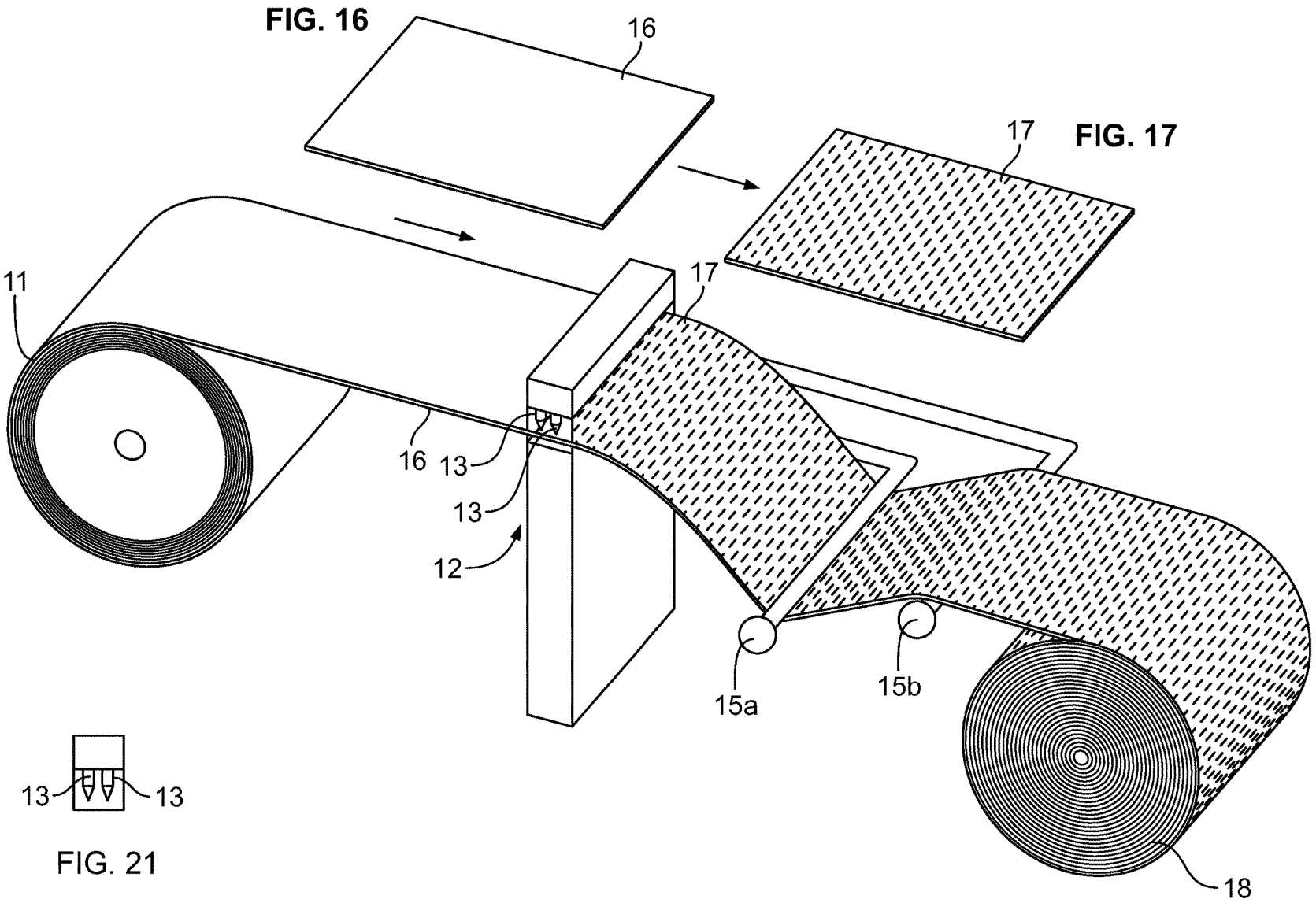
FIG. 15 illustrates the first stage of the manufacturing process where the paper board is prepared for expansion.
FIG. 21 illustrates the cutting knives of the first stage.

FIG. 15 illustrates the first stage of the manufacturing process where the paper board base product is expanded. A paper board roll 11, such as the Cupstock Low Moor paperboard mentioned above is supported on a stand 111 which allows it to be unrolled into a continuous strip 16 and guided to a cutting station 12 where offset cutting knives 13, also shown in FIG. 21, to produce the raw knife cut paperboard 17 which passes a flow control arm 15*a* and 15*b* and then rewound into a roll 18 for storage before further processing by stretching, heating, cooling, and cutting, final packing process. In FIGS. 16 & 17 sections of the continuous strip 16 and raw knife cut paperboard 17 have been shown in offset to clarify the difference between the two. It should be understood that an optional printing station can be added to print logos, colors or text on the continuous strip or the raw knife cut paperboard.

Figures 18, 19, 20:
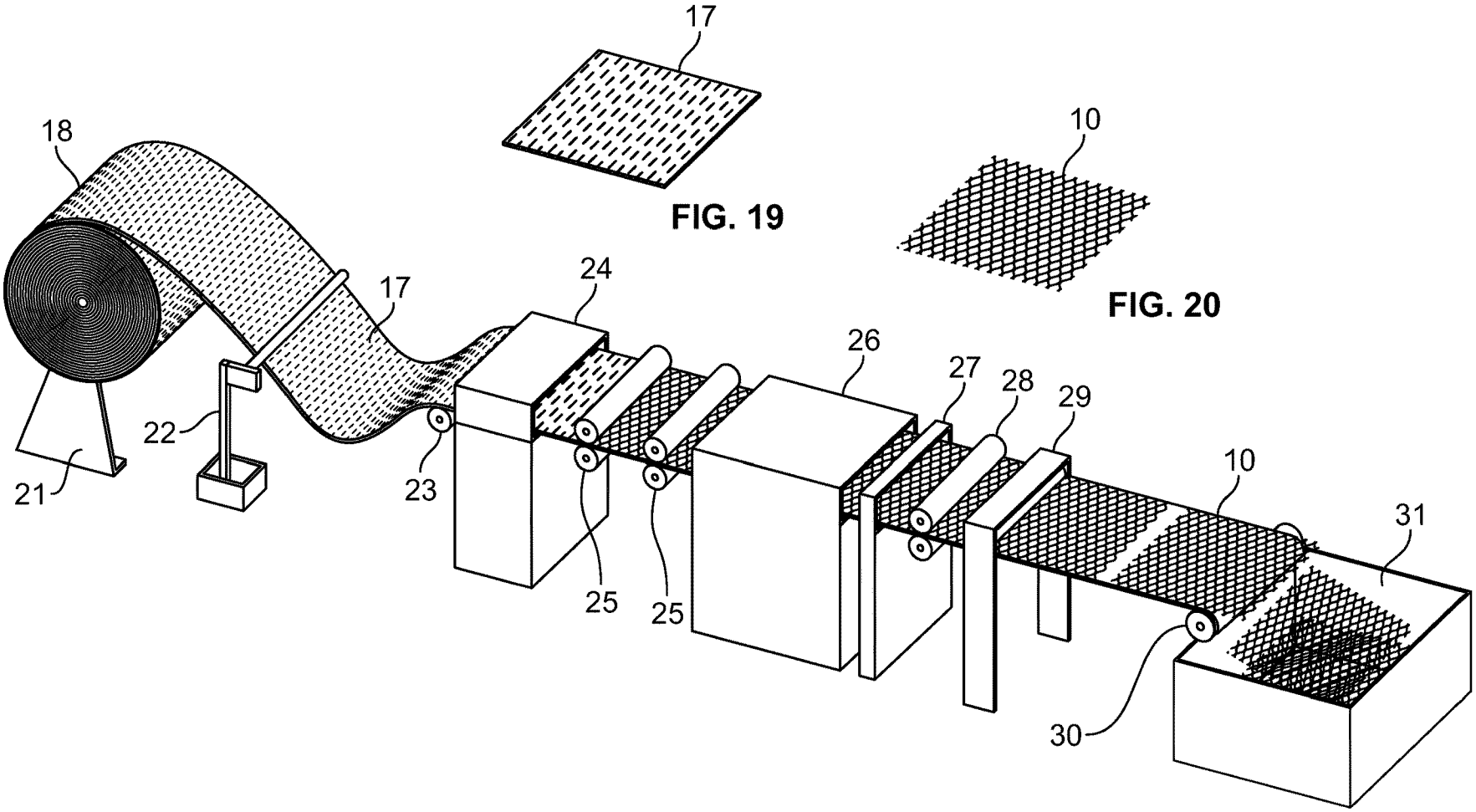
FIG. 18 is a pictorial depiction of the final manufacturing process.
FIGS. 19 and 20 illustrate the difference between the knife cut paper hoard and the expanded paperboard tray.

With reference to FIG. 18, in the final manufacturing process, feed stand 21 feeds the roll 18 of raw knife cut paperboard 17 to a flow control arm 22, then to a passive feed roll 23. From the passive feed roll 23, the strip of raw knife cut paper board 17 is drawn by two pre-stretching roller sets 25 through a misting applicator 24. Misting applicator 24, comprising a set of nozzles which are connected to a supply of flowable additives, may be used to apply the additives as desired for such purposes as extra moisture proofing or for preserving the shelf life of fresh produce. An additional roller beneath the strip of paper board also applies the additive to the board. By way of example Zeolite can be applied at the misting station for a variety of purposes including use as an antimicrobial and for physical stability of the paperboard, Likewise, RHOBARR™ 110 an acrylic copolymer latex, available from The Dow Chemical Company, designed for use in paper and board coatings offering oil and grease and water barrier properties can be applied at the misting station. The pre-stretching roller sets 26 tension the strip of raw knife cut paperboard to cause an initial expansion of the paperboard to form a strip of raw expanded paperboard. It will be understood that the process opens the slits into apertures 101 through the paperboard bounded by interconnected strands 102.

The strip of raw expanded paperboard is carried through a curing oven 26 under the influence of a second metering roll 28. The curing oven 26 is used to reduce the moisture content of the expanded paperboard, thereby causing the paperboard to retain. Its expanded shape, Accordingly, the temperature of the oven 26 and the dwell time of the paper is variable, depending on the thickness of the paper being used as the base stock and the desired rigidity of the final product. For example, a pizza tray may be very rigid whereas a vegetable tray may require a somewhat softer tray that has a little give to it. For most applications an oven temperature of about 300 degrees F. to about 380 degrees F. with a dwell or transit time of between about 10 to about 26 seconds. The purpose of the oven is to drastically reduce the moisture in the paperboard strip from the approximately 6.5% moisture content normally found paperboard. Thus the right combination of temperature and time will necessarily be adjusted as the product is manufactured.

The second metering roll 28 which is used to control the amount of stretch imparted to the paper and therefor controls cell size and to a degree product width. That is to say, as tension causes the strip to elongate the cells change their shape and the strip becomes correspondingly narrower. When the strip of paperboard is at its desired width and cell profile, the curing oven 26 fixes the paperboard in this state by drying the board as noted above. The dwell time in the oven 26 is partially controlled by the second metering roll 28. Intermediate the second metering roll 28 and the oven 26 is a down draft cooler 27 to quickly cool and set the paper. Downstream of the second metering roll is the cutter 29 that cuts the rigid paper stream to form the proper size tray 30 from the board with the misting applied, pre-stretched, cured and set, now with an open cell structure and strand height, cut to individual size. The cut tray 10 can be carried by any suitable conveyor 30 for placement into a shipping carton 31. For clarity in FIGS. 19 & 20 we depict before and after views of the raw expanded board 17 and the cured stretched and cooled board tray 10 now with an open cell structure. Printing is desired but not implemented previous to this step, note that a printing station can be implemented before or after the cutter as well.

In use, the upward elevations of the now cured and moisture impervious surface of tray 10, serve to elevate the pie from the pizza carton, thus supporting the pie above its own grease and liquid that would accumulate in a conventional scenario. The second advantage of elevating the crust from the carton base is to allow an air flow under the pizza crust and inhibit the carton base from absorbing too much heat from the pie crust.

In the produce usage, the tray 10 allows for greater air circulation under the fresh produce and isolates it from the typical plastic clamshell base.

With respect to the above description then, it is to be realized that the optimal dimensional relationships for the invention, to include variations in size, materials, color, shape, form, function and manner of operation, assembly and use, are deemed readily apparent to one skilled. in the art. All equivalent relationships to those illustrated in the drawings and described in the specification are intended to be encompassed by the present invention.

While in the foregoing specification this invention has been described in relation to certain embodiments thereof~and many details have been put forth for the purpose of illustration, it will be apparent to those skilled in the art that the invention is susceptible to additional embodiments and that certain of the details described herein can be varied considerably without departing from the basic principles of the invention.

What is claimed is:

1. A food carton combination comprising:

a food carton for holding food;

an expanded paperboard mesh food support in said food carton and over a surface of said food carton, said expanded paperboard mesh support formed by expanding a single piece of paperboard to define a plurality of adjacent apertures, wherein each aperture entire perimeter is bounded by adjacent strands;

a food item supported on said support, wherein said support supports said food item above said surface allowing for greater circulation of air under said food item, wherein each of said strands has an upper end opposite a lower end defining a height of said expanded paperboard mesh food support therebetween, wherein said food is supported by the upper ends of a plurality of said strands and wherein the lower ends of said plurality of said strands support said expanded paperboard mesh food support over said food carton.

2. The combination of claim 1, wherein the expanded paperboard mesh food support is made from biodegradable paperboard.

3. The combination of claim 2, wherein the expanded paperboard mesh food support comprises a mesh pattern selected from a plurality of patterns.

4. The combination of claim 2, wherein the strands have a strand height of between about 1/16 inch to about 1/4 inch.

5. The combination of claim 4, wherein each of the plurality of apertures has a diamond shape having a short dimension of about 5/16 inch and a long dimension of about 1/2 inch.

6. The combination of claim 5, having a transverse dimension of between about 3 1/2 inches to about 18 inches.

7. The combination of claim 2, wherein the expanded paperboard mesh food support is formed by heating.

8. The combination of claim 7, wherein the expanded paperboard mesh food support comprises at least one of a variety of colors.

9. The combination of claim 2, wherein the expanded paperboard mesh food support is printed with advertising.

10. The combination of claim 2, wherein the expanded paperboard mesh food support comprises a size and shape selected from a variety of sizes and shapes.

11. The combination of claim 2, wherein the expanded paperboard mesh food support is made from specialized paper having additives applied thereto for extra moisture proofing or for preserving the shelf life of fresh produce.

12. The combination of claim 2, wherein the food item is a hot pizza.

13. The combination of claim 2, wherein the food item is produce.

14. The combination of claim 1, wherein the expanded paper board is cured.

15. The combination of claim 14, wherein the expanded paperboard mesh food support is moisture impervious.

16. The combination of claim 1, wherein the expanded paperboard mesh food support is moisture impervious.

17. The combination of claim 1, wherein the food supported is formed by heating in a curing oven.

18. The combination of claim 1, wherein the expanded paperboard mesh food support is made from specialized paper having additives applied thereto for extra moisture proofing or for preserving the shelf life of fresh produce.

19. The combination of claim 1, wherein the food item is a hot pizza.

20. The combination of claim 1, wherein the food item is produce.

* * * * *